United States Patent [19]

Lohrman

[11] 4,358,031

[45] Nov. 9, 1982

[54] SAFETY CLOSURE AND CONTAINER WITH DISPENSING SPOUT

[75] Inventor: Richard D. Lohrman, Mundelein, Ill.

[73] Assignee: Owens-Illinois, Inc., Toledo, Ohio

[21] Appl. No.: 181,532

[22] Filed: Aug. 26, 1980

[51] Int. Cl.[3] ..... B65D 47/28; B65D 55/02

[52] U.S. Cl. ..... 222/153; 222/521; 215/216; 215/217

[58] Field of Search ..... 222/153, 519, 520, 521; 215/216, 217, 218

[56] References Cited

U.S. PATENT DOCUMENTS

| | | | |
|---|---|---|---|
| 2,104,413 | 1/1938 | Cahoon | 222/521 X |
| 2,542,350 | 2/1951 | Paulsen | 222/521 X |
| 3,578,223 | 5/1971 | Armour | 222/521 |
| 3,901,410 | 8/1975 | Schultz | 222/521 X |
| 3,941,268 | 3/1976 | Owens et al. | 215/216 |

FOREIGN PATENT DOCUMENTS

| | | | |
|---|---|---|---|
| 943452 | 12/1963 | United Kingdom | 222/521 |

*Primary Examiner*—Joseph J. Rolla
*Assistant Examiner*—Frederick R. Handren
*Attorney, Agent, or Firm*—John R. Nelson; Myron E. Click; David H. Wilson

[57] ABSTRACT

The invention comprises a combination of a container and a child resistant liquid seal closure with a dispensing spout. The container neck has one or more locking lugs which engage one or more locking lugs on the interior surface of the closure to prevent rotational removal of the closure from the container. A snap cap is retained within the closure, adjacent the inside surface of the top panel, and provides a primary liquid seal. The snap cap is provided with a dispensing spout, which is normally closed by the outer closure. To remove the closure, or to open the dispensing spout, the closure skirt must be squeezed and distorted to disengage the closure lugs radially outwardly from the locking lugs on the container neck.

1 Claim, 3 Drawing Figures

SAFETY CLOSURE AND CONTAINER WITH DISPENSING SPOUT

BACKGROUND OF THE INVENTION

The invention relates to safety closures for containers of dangerous or harmful contents which require a dispensing spout. To prevent access to contents by young children, removal of such closures requires purposeful manipulation in addition to mere rotation of the closure. One type of safety closure has a top panel and a depending annular skirt. The interior of the skirt is threaded to engage corresponding threads on the exterior of the container neck. The interior of the closure has one or more projecting locking lugs, which engage one or more corresponding locking lugs on the exterior of the container neck. Engagement of the locking lugs prevents the rotation necessary to remove the threaded closure from the container. Removal is possible only when the skirt is squeezed and distorted to force the closure locking lugs radially outward from engagement with the neck locking lugs.

Such safety closures, called "squeeze and turn" caps, are known in the prior art. U.S. Pat. Nos. 3,941,268 to Owens, et al and No. 4,117,945 to Mumford disclose safety closures and containers which require that the closure be squeezed to disengage locking lugs while the closure is rotated. To form a liquid seal, a compressible liner within the cap has been employed. An effective liquid seal on such prior art closures is achieved when the closure is snugly threadably engaged on the container neck, thereby compressing the liner. This construction is not however, effective for products requiring a dispensing spout. A child resistant safety closure with a dispensing spout is obviously desirable.

SUMMARY OF THE INVENTION

The invention comprises a safety closure of the squeeze and turn type, with a sealable spout for convenient dispensing of small amounts of fluid content. The primary seal against the container neck rim is formed by a snap cap retained within an outer closure. The snap cap is a separate plastic cap, but is permanently held in position within the outer closure, near the top, by a retention ring. An upstanding dispensing spout is provided on the panel of the inner snap cap, and is normally closed by a vertically sliding seal element carried by the panel of the outer closure. The snap cap has a lower annular bead which is formed to snugly engage an annular groove in the outer cylindrical surface of the container neck. As the outer closure is threaded downward onto the container neck, the snap cap is pushed into position around the neck. A liquid tight seal with container neck is thereby formed as the bead snaps into the cooperating annular groove in the neck. Concurrently, the vertically slidable sealing members for the spout opening are interengaged.

Since there is clearance between the snap cap and the outer closure panel at the top, and between the snap cap and the retention ring at the bottom, the snap cap is isolated from small movements of the outer closure. Therefore, once the snap cap is snapped into place, any additional rotation of the outer closure to effect the locking of the outer closure will not effect the seal between the inner snap cap and the container rim.

Cooperating locking lugs formed on the outer closure and the container neck normally prevent reverse rotation of the outer closure. To rotate the outer closure to open the dispensing spout or to completely remove the entire closure, the locking lugs must be disengaged by simultaneous squeezing and turning of the outer closure skirt.

DESCRIPTION OF PREFERRED EMBODIMENT

Figure 1:
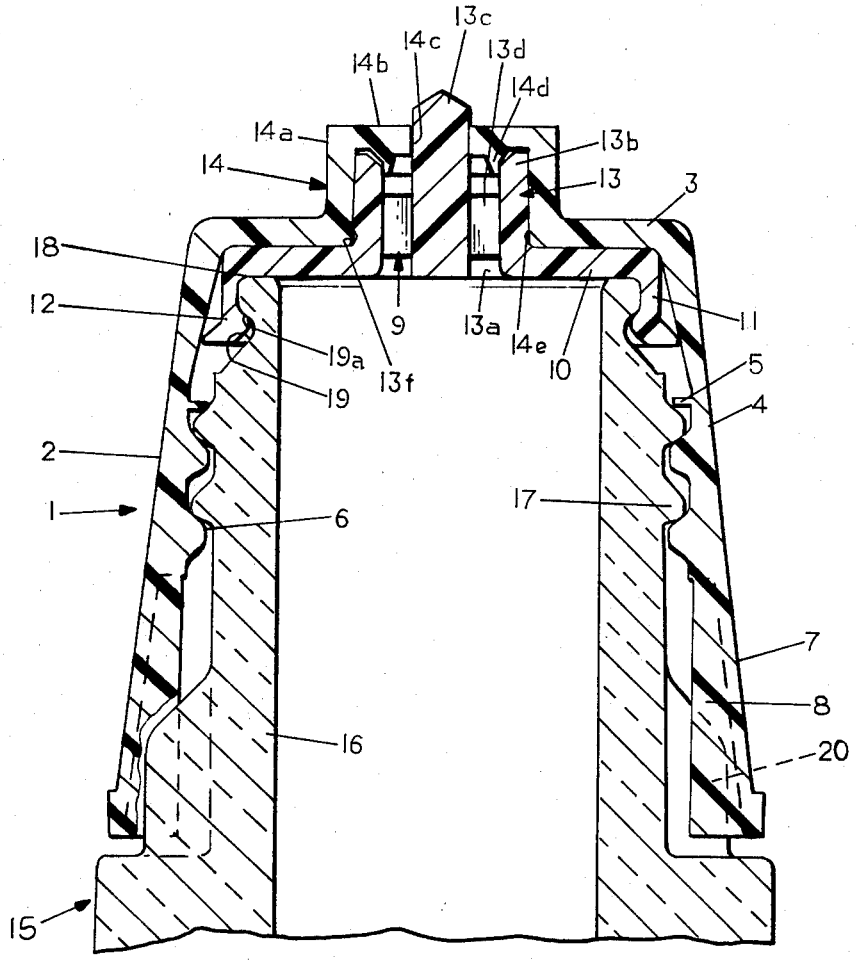
FIG. 1 is a sectional view of a dispensing spout closure and container embodying this invention, with the dispensing spout closed by the outer closure.

Referring now to the drawings, the invention comprises a safety closure 1 comprising an inner snap cap 9 and outer closure 2, and a container 15. The outer closure 2 has a top panel section 3 and an annular skirt section 4 depending from the periphery of the panel 3. On the inside surface of the skirt 4 near the top of the outer closure 2 is an inwardly projecting, annular retention ring 5 which has an inside diameter less than the outside diameter of the snap cap 9, but greater than the outside diameter of the container neck 16. Retention ring 5 may be either continuous or discontinuous. Below the retention ring 5, the inside surface of the skirt 4 is of generally cylindrical configuration with threads 6 formed thereon to engage a threaded container neck. Below the threaded section 6 of the skirt 4 is an outwardly tapering relatively thin walled lower skirt section 7. The lower skirt section 7 has a plurality of integral internally projecting locking lugs 8.

During manufacture, a dispensing spout snap cap 9 is press fitted within the outer closure 2. The dispensing spout snap cap 9 is composed of a top panel section 10 and a relatively short annular skirt section 11 depending from the periphery of snap cap panel 10. The bottom of the snap cap skirt 11 is thickened to form a snap bead 12. The panel section 10 of the snap cap 9 is provided with an upstanding dispensing spout 13. The spout comprises an annular wall **13*b*, concentric with the top panel 10 of the snap cap 9, extending above the top panel 10 and surrounding a dispensing opening 13*a* through the top panel section 10. Within the annular wall 13*b*, and concentric with annular wall 13*b* and top panel section 10, is an axially extending cylindrical plug 13*c*, extending above the top of the wall 13*b*. Plug 13*c* is held in position by a plurality of integrally formed radial bars 13*d*, connecting annular wall 13*b* and cylindrical plug 13*c*. Plug 13*c* and annular wall 13*b* cooperate to define an annular fluid passageway 13*a* through the dispensing spout 13**.

The dispensing spout 13 is normally surrounded and closed by a vertically slidable sealing element comprising a cooperating concentric sleeve 14 intergrally formed on the panel 3 of outer closure 2. The sleeve 14 comprises an annular wall **14*a* extending vertically from panel 3, and an integral panel 14*b* that covers the top of sleeve 14. Sleeve panel 14*b* has a center hole 14*c* sized to snugly receive the plug 13*c* to form a vertically slidable seal therewith. The inside diameter of annular wall 14*a* is approximately equal to the outside diameter of annular wall 13*b*. When the snap cap 9 and outer closure 2** are preassembled the dispensing spout 13 is pressed into sliding, sealing engagement with the sleeve 14.

As the sleeve 14 is moved axially upward relative to spout 13, the sleeve panel 14*b* moves above and out of sealing engagement with plug 13 while annular walls 13*b* and 14*a* are still in sliding sealing engagement. In this open spout position fluid may flow through passage 13*a*, over plug 13*c* and through hole 14*c*. Since the walls 13*b* and 14*a* must remain in sealing engagement in both the spout open and spout closed position, two additional sealing members are provided. A downwardly projecting annular rib 14*d* is integrally formed on the inside of sleeve cover 14*b*. When the sleeve 14 is in its downward closed spout position, rib 14*d* abuts the inside surface of wall 13*b*, to form a liquid seal. A second seal member comprises an integral, inwardly projecting rib 14*e* formed on the bottom inside surface of sleeve wall 14*a*. As the sleeve 14 slides between its upper and lower positions, rib 14*e* is compressed between sleeve wall 14*a* and spout wall 13*b* to create a liquid seal.

A container 15 to cooperate with the safety closure 1 has a generally cylindrical neck section 16, with an external threaded section 17 formed to engage the corresponding threads of the outer closure 2. The neck 16 has an annular rim 18 defining a dispensing opening. Immediately below the container rim 18 an annular groove 19 is formed to snugly engage the snap bead 12 of the snap cap 9. The upper surface 19*a* of groove 19 is tapered upwardly and outwardly towards rim 18. Projecting from the cylindrical neck section 16, below the threaded section 17, are a plurality of outwardly projecting locking lugs 20. These locking lugs 20 project far enough to engage the corresponsing locking lugs 8 on the outer closure 2. The container lugs 20 do not extend far enough to contact the inside surface of the lower tapered skirt section 7, except at the locking lugs 8.

The locking feature of the closure functions in the same manner as the locking feature disclosed in U.S. Pat. No. 3,941,268 to Owens and Smalley. In general, as the outer closure 2 is screwed onto the container 15 the locking lugs 8 projecting inwardly from the flexible skirt section 4 are cammed outward by camming surfaces on container lugs 20. When the outer closure 2 is in place, rotation to remove the outer closure 2 is prevented by the engagement of locking lugs 8 and container locking lugs 20. The flexible skirt section 7 must be deformed by pressure at points opposite locking lugs 8, thereby forcing the lugs 8 radially outward, so that lugs 8 and 20 no longer interfere with rotation of the closure 2.

As the closure 2 is threadably rotated onto the container neck 16, the locking lugs 8 and 20 engage just before the inner snap cap 9 is pressed into sealing relationship with the container rim 18. A small additional rotation after the closure locks will bring the outer panel 3 into contact with the snap cap panel 10, so the snap cap 9 can be pressed into position (FIG. 1).

Figure 2:
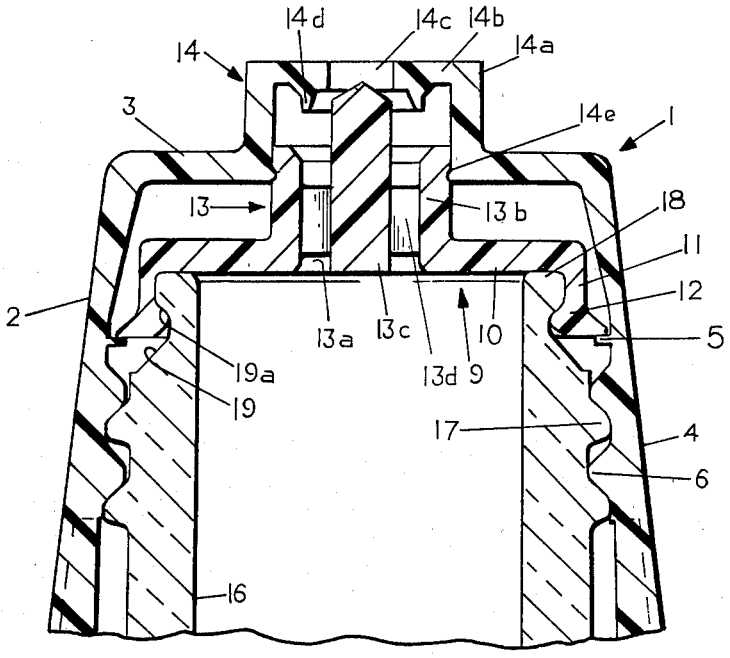
FIG. 2 is a sectional view similar to FIG. 1, but showing the outer closure partially removed, to open the dispensing spout.
Figure 3:
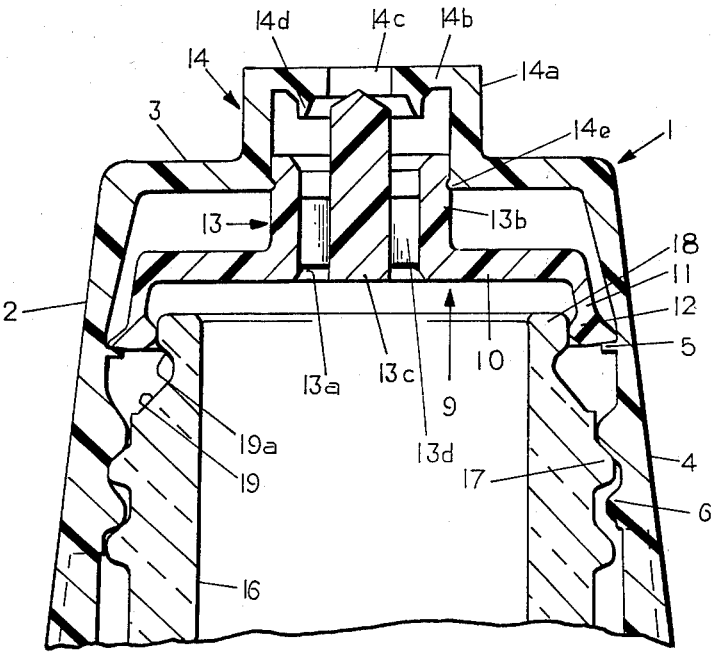
FIG. 3 is a sectional view similar to FIG. 2, but showing the outer closure further rotated, and lifting the inner closure from engagement with the container.

To open the dispensing spout, the flexible lower skirt section 4 is squeezed to disengage the locking lugs, and the outer closure 2 is rotated, until cover panel hole 14*c* is no longer sealed by plug 13*c*. Fluid may then flow through the annular passage 13*a*, over the top of plug 13*c*, and through the dispensing opening 14*c* (FIG. 2). The retention ring 5 is spaced far enough below the outer closure top panel 3 to allow this vertical movement of the outer closure 2, without pushing the inner snap cap 9 out of engagement with the container neck rim 18. To completely remove the entire closure for pouring, the outer closure 2 is further squeezed and rotated so that the retention ring 5 lifts the snap cap liner 9 off the container rim 19. While the preferred embodiment employs a retention ring 5, it should be noted that closure threads 6 could also be used to retain inner cap 9, and the retention ring 5 could be eliminated.

Preferably, the relationship of the locking elements to the sealing elements is such that a single squeeze with a 180° turn of the closure 1 will open the spout 13, and a second squeeze and 180° turn will remove both outer closure 2 and inner cap 9 to expose the container rim 18 for pouring.

Modifications of this invention will be apparent to those skilled in the art, and it is intended that that scope of the invention be determined solely by the appended claims.

What is claimed is:

1. An improved child-resistant safety closure with a dispensing spout adapted for threadable attachement on a container having a generally cylindrical, hollow dispensing end including an externally threaded neck portion, an annular rim defining a dispensing opening, an annular groove adjacent said dispensing opening, and locking means on said container engageable by at least the last 360° rotation of the closure relative to the container, said closure comprising: an outer closure element having a top panel and an annular skirt depending therefrom; said annular skirt portion including threads on the interior surface thereof adapted to engage the threads of the neck portion of the container, and manually releasable detent means engageable with said container locking means; an inner closure element having a top panel and an annular skirt depending from the periphery of said inner closure panel; means on said inner closure skirt to detachably engage said annular groove in the container to effect a sealing engagement of the inner closure element with the annular rim of the container, a dispensing spout defining a dispensing opening in said panel of said outer closure element, means on said panel of said inner closure element sealingly engageable with said dispensing opening by movement of said outer closure element to its fully engaged position on the container threads, said dispensing opening being disengaged from said sealing means by approximately 180° rotation of said outer closure element away from said fully engaged position; a dispensing aperture in said panel portion of said inner closure element, thereby permitting dispensing flow of the container contents through said inner closure element; internally projecting means on the skirt portion of said outer closure element for retaining said inner closure element within said outer closure element, said last mentioned means permitting a limited axial movement of said outer closure element as a result of 180° reverse rotation without interfering with the sealing engagement of said inner closure element with the container annular rim, but removing said inner closure element from the container rim when said outer closure element is moved upwardly by an amount corresponding to approximately 360° rotation of said outer closure element from said fully engaged position on the container threads.

* * * * *